US005483808A

United States Patent [19]

Barbazza

[11] Patent Number: 5,483,808

[45] Date of Patent: Jan. 16, 1996

[54] ANNULAR STRUCTURE MEANT FOR PIECES OF REAL JEWELRY AND CHEAP JEWELRY, PARTICULARLY FOR RINGS

[76] Inventor: Piero Barbazza, Via Vincenzo Bellini, 6, I-15048 Valenza, Province of Alessandria, Italy

[21] Appl. No.: 304,774

[22] Filed: Sep. 12, 1994

[30] Foreign Application Priority Data

Sep. 14, 1993 [IT] Italy ..... AT93U0007

[51] Int. Cl.[6] ..... A44C 9/00

[52] U.S. Cl. ..... 63/15.5; 63/15.4

[58] Field of Search ..... 63/15.1, 15.2, 63/15.3, 15.4, 15.45, 15.5, 15.6, 15.65; 285/298

[56] References Cited

U.S. PATENT DOCUMENTS

| | | | |
|---|---|---|---|
| 221,728 | 11/1879 | Halsey | 63/15.4 |
| 1,327,606 | 1/1920 | Bacharach | 63/15.2 |
| 1,333,284 | 3/1920 | Schreiber | 63/15.4 |
| 1,586,606 | 6/1926 | Cain | 63/15.4 |
| 1,613,887 | 1/1927 | Gunn | 285/298 |
| 2,060,345 | 11/1936 | Phillips | 63/15.3 |
| 3,081,999 | 3/1963 | Harris | 285/298 |
| 3,745,788 | 7/1973 | Sullivan | 63/15.6 |
| 4,226,094 | 10/1980 | Wolpoff | 63/15.4 |
| 4,526,016 | 7/1985 | Cercone | 63/15.6 |
| 5,228,316 | 7/1993 | Meyrowitz | 63/15.4 |

FOREIGN PATENT DOCUMENTS

| | | | |
|---|---|---|---|
| 25697 | 3/1883 | Germany | 63/15.1 |
| 4210982 | 10/1993 | Germany | 63/1.1 |
| 20155 | 10/1895 | United Kingdom | 63/15.1 |

*Primary Examiner*—Michael J. Milano
*Attorney, Agent, or Firm*—Larson and Taylor

[57] ABSTRACT

The invention consists in an annular structure which is suitable for making pieces of both real and cheap jewelry or the like, particularly rings. The annular structure of the invention is axially extensible in a telescopic manner. According to one preferred embodiment, this annular structure consists of a plurality of annular elements (1, 2), particularly two annular elements (1, 2) which are coaxially mounted the one inside the other, with the diameters of these annular elements being suitably reduced gradually with respect to each other, and each external annular element (1) being connected to the adjacent internal annular element ( 2 ) in such a manner that the former is shiftable relative to the Latter, alternatively to a position in which the external annular element (1) is entirely or at least partly superposed on the internal annular element (2), and to a position in which this latter element (2) is entirely or at least partly exposed by the external annular element (1) coming to be axially set sideways of the internal annular element (2), so that the internal annular element is entirely or at least partly visible.

6 Claims, 5 Drawing Sheets

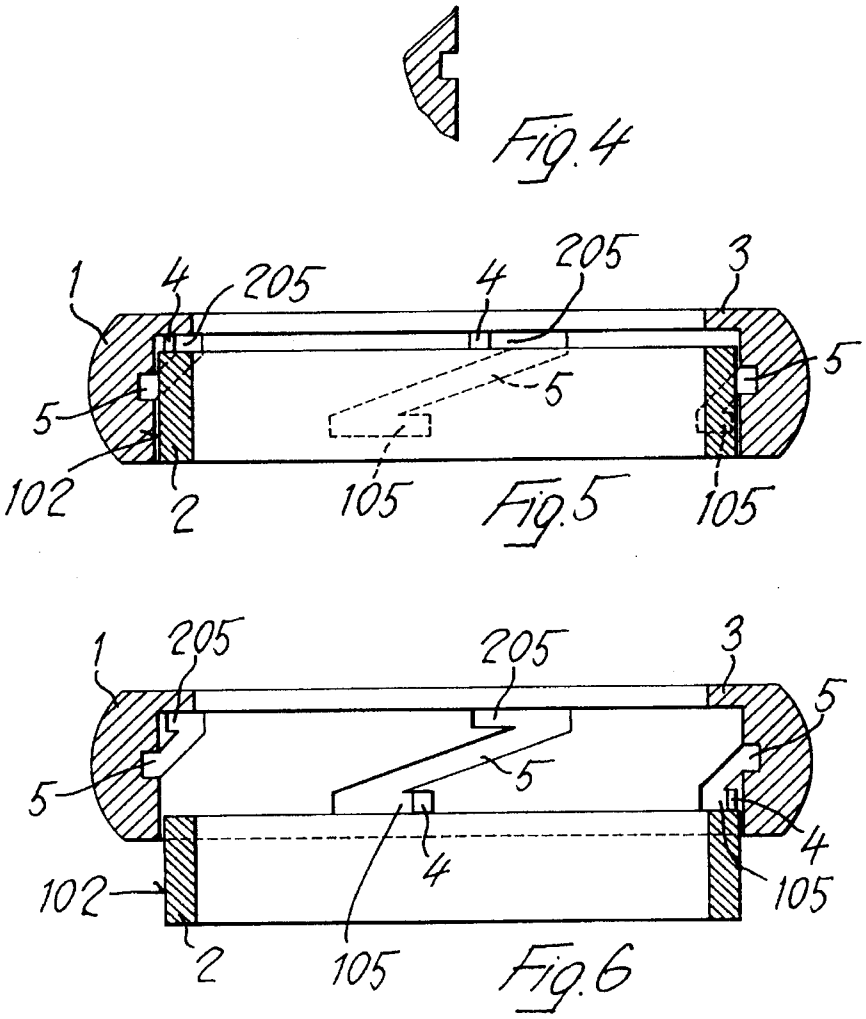
Fig. 4
Fig. 5
Fig. 6
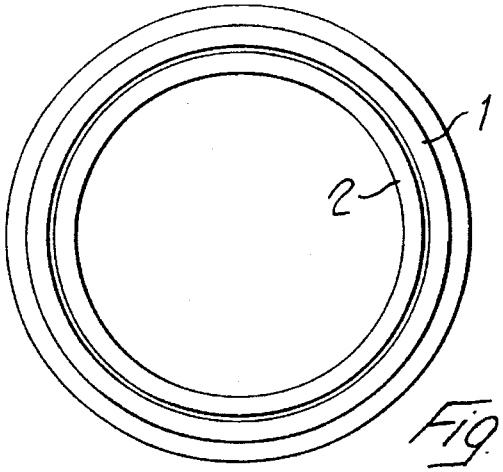
Fig. 1
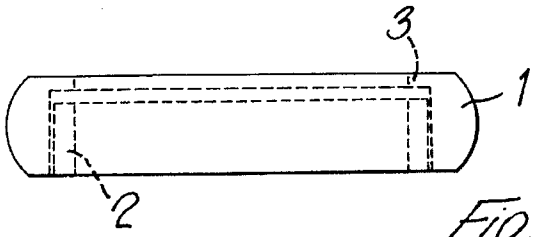
Fig. 2
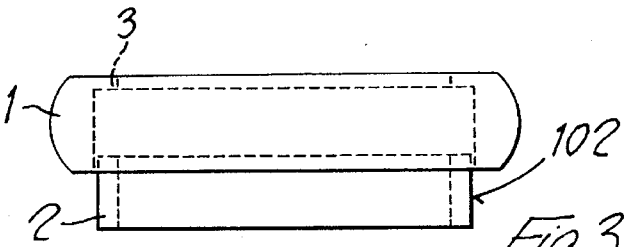
Fig. 3

ANNULAR STRUCTURE MEANT FOR PIECES OF REAL JEWELRY AND CHEAP JEWELRY, PARTICULARLY FOR RINGS

FIELD OF THE INVENTION

The invention refers to an annular structure which is suitably applicable to various pieces of both real and cheap jewelry or the like and particularly to rings.

SUMMARY OF THE INVENTION

In the field of jewelry, to seek for novel and attractive features of jewels is, as known, an imperative need. Additionally, as matters presently stand, two contrary requisites are involved, that is, the desire of wearing a high value and then expensive jewel, and the need of being surely protected against theft or robbery, by avoiding to attract too much attention in public places.

The object of the invention is to realize a jewel in form of an annular structure, particularly a ring, with a varying aesthetic appearance depending on a person's requirements, whereby it is possible to personalize and adapt a jewel to any circumstance in a rather inexpensive manner, so as to reconcile the aforementioned contrary requisites. This is achieved thanks to the provision of a simple and relatively low-cost construction, and without compromising or excessively limiting the aesthetic configuration of a jewel.

These objects are attained with the provision of an annular structure, particularly a ring, which is axially extensible in a telescopic manner.

The ring of the invention consists of a plurality of annular elements, particularly of two annular elements, which are each coaxially mounted the one inside the other, with the diameters thereof being suitably reduced gradually with respect to each other, and each external annular element being connected to the adjacent internal annular element in such a manner that the former is shiftable relative to the latter, alternatively to a position in which the external annular element is entirely or at least partly superposed on the internal annular element, and to a position in which this latter element is entirely or at least partly exposed by the external annular element coming to be axiallly set sideways of the internal annular element, so that the internal annular element is entirely or at least partly visible.

The diameter of the internal annular element obviously corresponds to the diameter allowing the annular structure to be threaded on a finger of a person's hand.

The means for reciprocally connecting the annular elements may be of any suitable type and should be suitable for effecting a relative coaxial shiftment to either of the above disclosed positions, simply by an axial translation or by a combined rotary and translatory movement of the external annular element.

The internal annular element may be provided with an annular axial extension having a greater diameter at its rear end edge lying opposite to the external annular element. The annular extension is meant for being kept beside the external annular element in the position in which this element is superposed on the internal annular element, and this annular extension may have any suitable size and shape which may be substantially the same as, or complementary to the external annular element.

Thus, in one single object, more than two annular elements can be arranged and combined, which may exhibit different ornaments, inscriptions, and precious, semi-precious or artificial stones, or the like, and may be made from various materials. The ornaments and the precious or semi-precious stones may be set in the internal annular element, so that these may be revealed at a user's discretion. The external annular element is always kept visibile, and it may be so decorated or made as to be moderately attractive. The annular structure can be manipulated in a really simple and safe manner as for what concerns the risk that one annular element may accidentally come out of the other, since end of travel abutments for the external annular element and possible means for locking it both in the superposed position on the internal annular element and in the internal annular element exposing position, are provided. Such a construction also permits to personalize an annular structure by affixing by means of any suitable process on the smaller diameter internal annular element an information, a dedication, a sign of the zodiac, or the like, which may be displayed only at a user's discretion.

When in closed condition, the annular structure is in form of one single, relatively not striking object, whereby a user is surely protected against inquisitive or ill-intentioned people.

Further features form the subject of the dependent claims.

The features of the invention will appear more in detail from the following description of some embodiments which are shown in the accompanying drawings.

BRIEF DESCRIPTION OF THE DRAWINGS

FIG. 1 is an axial view showing an annular structure according to the invention.

FIGS. 2 and 3 are side views showing the annular structure according to FIG. 1, with the external annular element respectively in the superposed position on the internal annular element and in the internal annular element exposing position.

FIG. 4 is a cross-sectional view showing a guide for the shifting of an external annular element.

FIGS. 5 and 6 are axially sectional views showing the annular structure according to FIGS. 1 to 4, with the external annular element respectively in the superposed position on the internal annular element and in the internal annular element exposing position.

DESCRIPTION OF THE PREFERRED EMBODIMENTS

Figure 7:
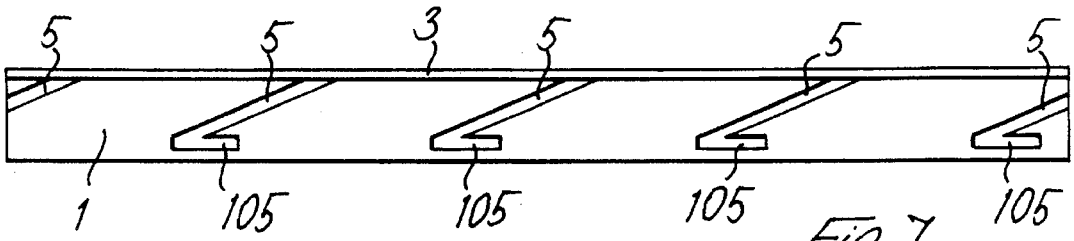
FIG. 7 shows a plan development of the inner side of the external annular element.
Figure 8:
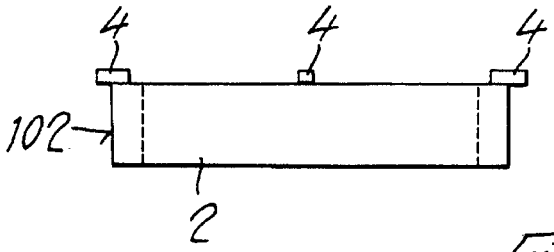
FIGS. 8 and 9 are a side view and an axial view of the internal annular element.
Figure 9:
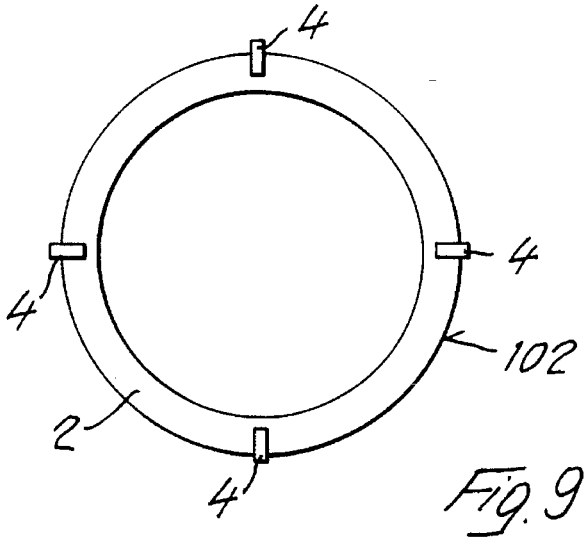
Figure 10:
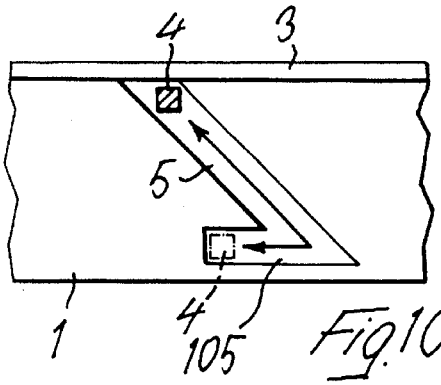
FIGS. 10 to 15 show similarly to FIG. 7, an equal number of modified embodiments of the slide guides on the inner side of the external annular element.

Shown in FIGS. 1 to 3 is a first embodiment of an annular structure made according to the present invention. The annular structure consists of two annular elements 1 and 2, coaxially fitted the one into the other. These two annular elements are so connected to each other that the external annular element 1 is coaxially shiftable relative to the internal annular element 2, alternatively to a position in which it is superposed on the internal annular element 2, and to a position in which it exposes the internal annular element 2.

The inside diameter of the internal annular element 2 corresponds to the diameter allowing the ring structure to be threaded on a finger of a person. Therefore, the internal annular element 2 remains stationary, and it is the external annular element 1 that is moved.

In the following discussion and in the claims, fore end edge and rear end edge are referred to the direction in which the external annular element 1 is shifted for exposing the internal annular element 2.

The external annular element i when in superposed position on the internal annular element 2, is entirely superposed thereon, since these two elements have complementary axial dimensions. The external annular element 1 is formed at the fore end edge thereof with an end of travel abutment consisting of a flange or annular projection 3.

To expose the internal annular element 2, the internal annular element 2 of a smaller diameter is axially shifted laterally outwardly by the external annular element 1 and extends therefrom by at least a part of its axial extent. By its edge turned toward the external annular element 1, the internal annular element 2 is kept engaged therewith by abutments ending the travel of the external annular element 1 for exposing the internal annular element 2.

Referring to FIGS. 5 to 9, the internal annular element 2 is provided at its edge turned toward the external annular element 1, with at least two, preferably more than two, particularly four radial teeth 4 extending outwardly from the outer skirt surface 102 of the internal annular element 2. These radial teeth 4 are to be slidably engaged each in the respective guide path 5 in the inner wall of the external annular element 1. In the example according to FIGS. 4 to 7, and 10, the guide paths 5 are in form of guide slots 5 substantially helical in shape and arranged parallel to each other. The shiftment of the external annular element 1 from its superposed position on the internal annular element 2, to the internal annular element exposing position, and vice-versa, is effected by a rotary and translatory movement, i.e., by a movement for screwing the external annular element 1 on the internal annular element 2, and for unscrewing it therefrom.

According to an improved embodiment, the guide slots 5 may be provided with a circumferential end section, i.e., perpendicular to the axis of the annular structure, at least at one end thereof lying near to one of the two fore and/or rear end edges of the external annular element 1. In the example according to FIG. 10, the end section 105 is provided only at the guide slot 5 ends which are adjacent to the external annular element 1 rear end edge, and forms both an end of travel abutment for the external annular element 1 having been shifted so as to place the internal annular element 2 in its exposed position, and a means for locking the external annular element 1 so as to prevent any accidental displacement thereof.

It is evident that as it clearly appears from FIGS. 4 to 7, and 11 to 15, different configurations of the guide slots 5 may be contemplated.

Figure 11:
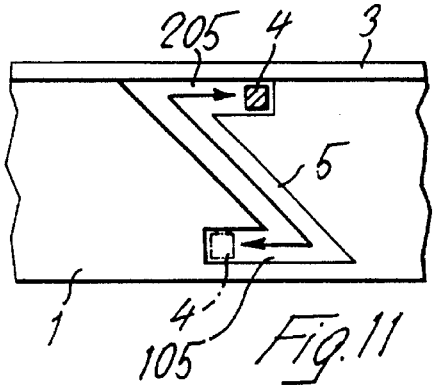
Figure 12:
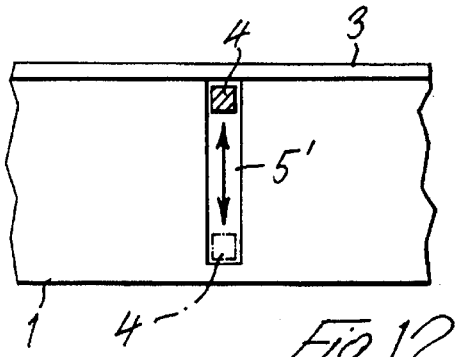
Figure 13:
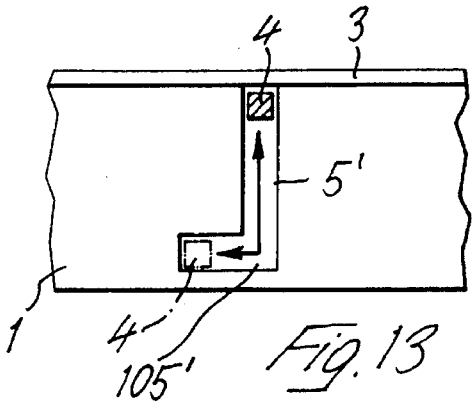
Figure 14:
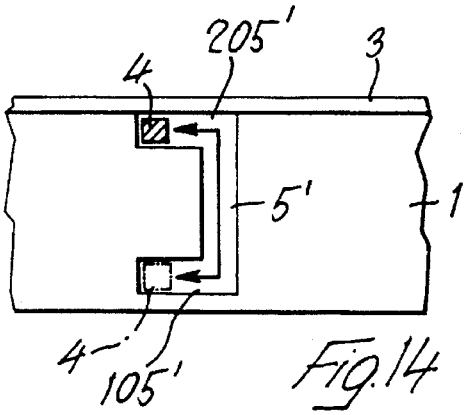

As shown in FIGS. 5, 6, and 11, the helical guide slots 5 are also provided with a further end section 205 which is perpendicular to the axis of the annular structure, at the ends thereof lying near to the external annular element 1 fore end edge. This further end section 205 extends parallel to the abutment flange 3 and is oriented in the contrary direction with respect to the end section 105 at the guide slots 5 opposite ends, FIGS. 12, 13, and 14 show three modified embodiments of the guide slots, which are comparable to the just described examples. The guide slots 5' are here arranged in the axial direction of the annular structure. Shown in FIGS. 13 and 14 are two modified embodiments of the guide slot 5' according to FIG. 12, which are equivalent to the embodiments of FIG. 10 and FIG. 11. The guide slot 5' according to FIG. 13, is provided with a circumferential end section 105' which is perpendicular to the axis of the annular element 1 and is adjacent to the rear end edge thereof. The guide slot 5' according to FIG. 14, is also provided with the circumferential end section 205' which is perpendicular to the axis of the annular element 1, and is adjacent to the fore end edge thereof. Moreover, as shown in FIG. 14, both guide slot end sections 105', 205' are arranged in the same direction, but opposite directions thereof may be also contemplated.

Figure 15:
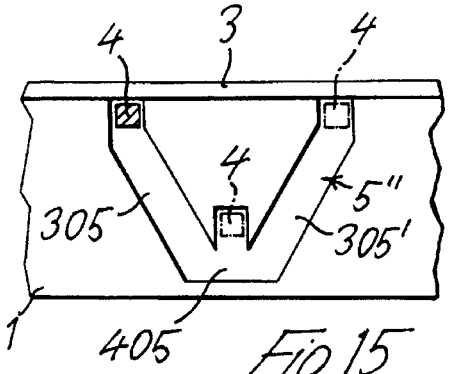
Figure 17:
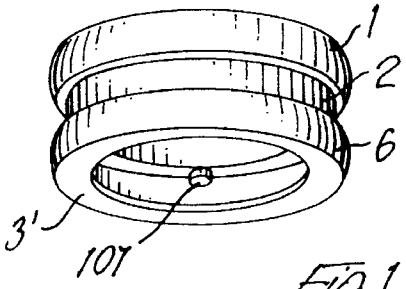
FIGS. 16 and 17 are perspective views showing a modified embodiment of the annular structure according to the invention, with the external annular element respectively in the superposed position on the internal annular element and in the internal annular element exposing position.
Figure 19:
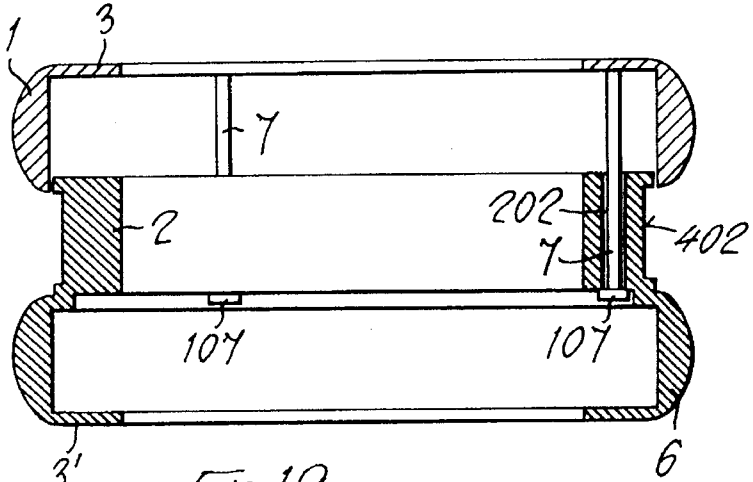
FIGS. 18 and 19 are axially sectional views of the annular structure according to FIGS. 16 and 17.
Figure 16:
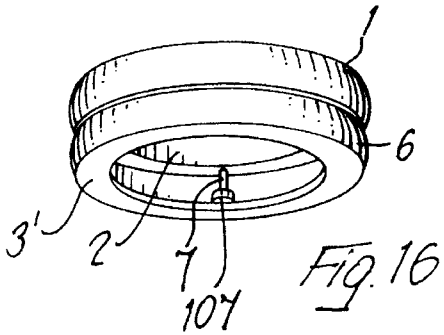
Figure 18:
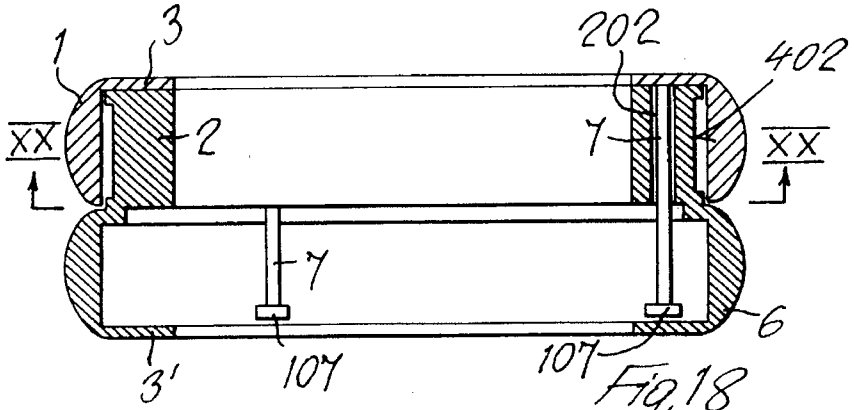

In the modified embodiment according to FIG. 15, the guide slot 5" is provided with an inverted T-shaped section 405 lying near to the external annular element 1 rear end edge. This T-shaped section 405 is formed by an axially arranged stem and a circumferential base being perpendicular to the axis of the annular element 1 and having the ends connected with two helical branches 305, 305'. These helical branches 305, 305' extend in a diverging relation to the opposite fore end edge of the annular element 1, i.e., to the abutment fore flange 3 formed thereon. Thanks to this contrivance, the external annular element 1, is moved from the position in which it is superposed on the internal annular element 2, which in this case substantially is a complete superposition, to the position for exposing the annular element 2. The external annular element 11 is subsequently moved again into its superposed position by a rotation being effected always in the same direction, and which depending on the helical branch 305, 305', is associated with a translation in the one and the opposite direction. In the middle position in which the radial teeth 4 are located in the axial stem of the T-shaped section 405, the external annular element 1 is substantially locked both against a rotation and a translation relative to the internal annular element 2. To effect a further shiftment of the external annular element 1, this element should be moved again in the axial direction away from the internal annular element 2, whereby the radial teeth 4 thereon are moved into the base of the T-shaped section 405, which is perpendicular to the axis of the annular element 2.

Of course, the guide slots may even have different courses, for example such a course that with the abutment flange 3 on the external annular element 1 being omitted, the shiftment of this element 1 from the position in which it is superposed on the internal annular element 2 to the position for exposing the annular element 2 can be effected as desired in either of the two senses of the axial direction. This may be achieved by, for example, providing the teeth 4 in the area of the median transversal plane of the internal annular element 2, and the guide slots may be provided with a circumferential section which is perpendicular to the axis thereof, in the area of the median transversal plane of the external annular element 1.

The guide slots which according to FIG. 4 are quadrangular in cross-section, may also have a differently shaped cross-section, such as, for example, a triangular, part-circular, concave, dovetail cross-section, or a cross-section in form of a circle sector with a suitably wide angle.

In lieu of the foregoing arrangement, the translatory or rotary and translatory connection of the two annular elements 1, 2 may be effected even by the provision of complementary guide slots respectively made in the inner skirt of the external annular element i and in the outer skirt of the internal annular element 2, rolling balls being inserted in the fashion of bearings between said complementary guide slots.

A furher variant may consist in the feature that the two annular elements 1, 2 are mutually engaged by means of external or internal complementary threads, or of partly threaded sections provided on these elements.

In FIGS. 16 to 20 there is shown a second embodiment of the invention. In this embodiment, the internal annular element 2 is provided at its edge lying opposite to the external annular element 1, with an annular axial extension 6 having a greater diameter than the internal annular element 2. In the shown example, the annular extension 6 substantially has the same shape and diameter as the external annular element 1. However, this annular extension 6 may have any suitable configuration depending on any aesthetic requisite. In this example, the internal annular element 2 is connected to the external annular element 1 by means of at least two, and preferably more than two, particularly three axial guide pins 7. These guide pins 7 are arranged in an angularly equispaced relation peripherally on the external annular element 1 inner skirt wall, with which the internal annular element 2 may become engaged thanks to the provision of axial bores 202. More particularly, the guide pins 7 are affixed to the abutment flange 3 at the fore end edge of the external annular element, The guide pins 7 are provided at their free rear ends with large heads 107 forming the end of travel abutments for the external annular element 1 being shifted to the position for exposing the internal annular element 2.

Advantageously, the annular extension 6 is provided at its rear end edge lying opposite to the internal annular element 2 with a radially inward peripheral flange 3' for covering the pins 7 outward portions.

Figure 21:
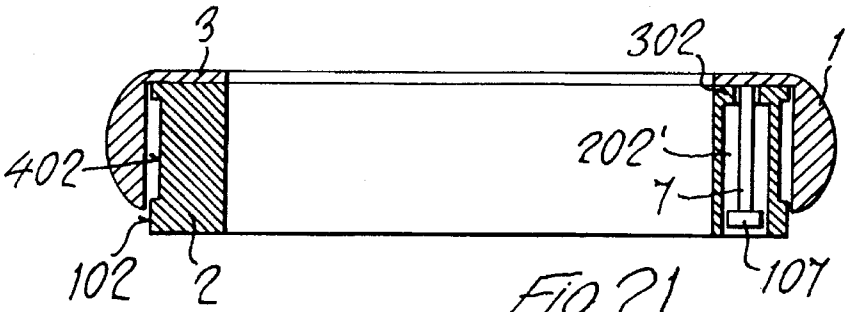
FIGS. 21 and 22 show a further modified embodiment of the annular structure according to the invention.
Figure 22:
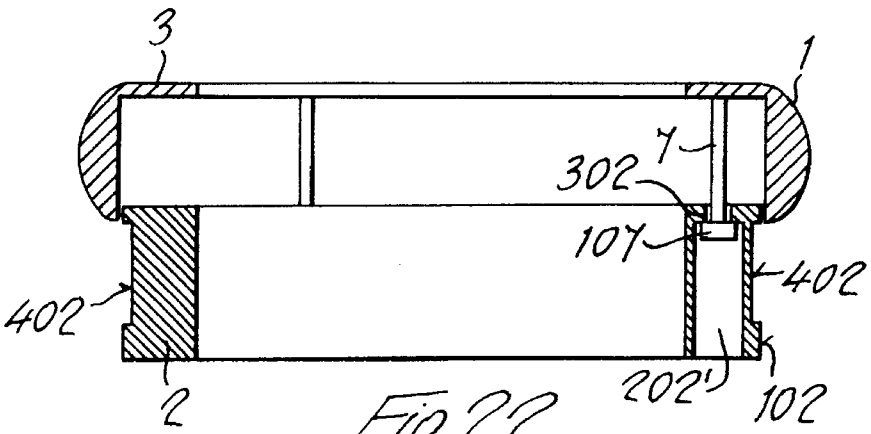
Figure 20:
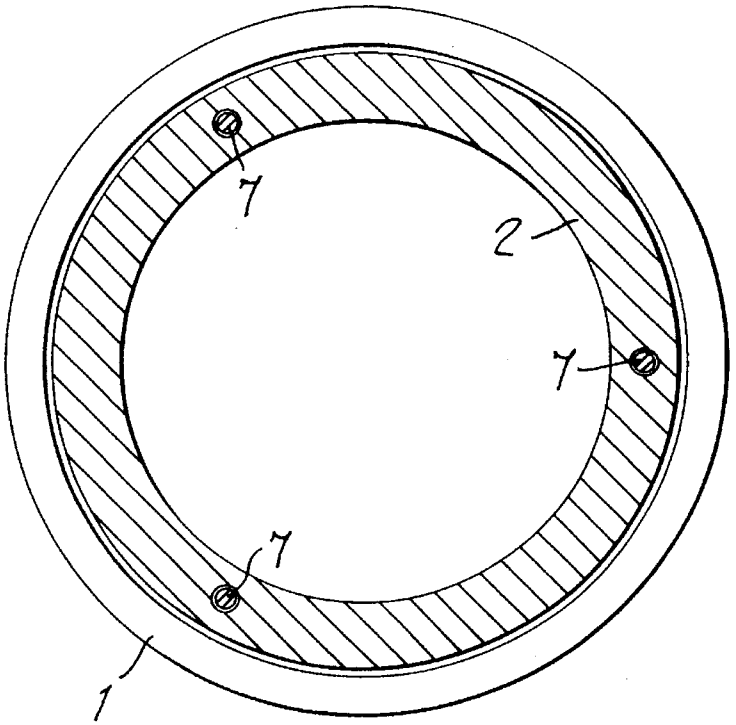
FIG. 20 is a cross-sectional view of the annular structure, taken on line XX—XX in FIG. 18.

In the modified embodiment according to FIGS. 21 and 22, the internal annular element 2 is not provided with an axial annular extension at its rear end edge. In this embodiment, the pins 7 have their large heads 107 slidably engaged in complementary axial bores 202', these bores being formed at their end edges facing the fore end edge of the internal annular element 2, with a narrowed annular portion 302.

From FIGS. 16 to 22 there also appears that the internal annular element 2 has its outer skirt surface 102 provided with a radially re-entrant annular strip 402 meant for ornaments, ornamental stones, or the like, to be affixed thereon, without the diameter of the annular structure being substantially increased.

Only two annular elements 1, 2 are shown in the illustrated embodiments. It is of course possible to provide, in accord with the foregoing disclosure, annular structures having three or more annular elements coaxially arranged the one inside the other and connected so as to be laterally shiftable the one relative to the other, so that a telescopic elongation to an important extent and with various ranges of aesthetic impressions is obtained.

Apart from the correlation between the diameters of external and internal annular elements, the telescopic annular structure according to the invention, is not susceptible of any limitation in the aesthetic or formal appearance of its annular components. These components may be, for example, also undulated radially or relative to the transversal plane.

The annular structure as shown herein is not limited to the manufacturing of rings, but may be also used for other pieces of jewelry, such as bracelets, ear-rings, pendants, brooches and the like.

I claim:

1. An annular structure for pieces of jewelry comprising an external annular element having a fore end edge, a rear end edge and an inner skirt surface and an internal annular element having an outer skirt surface, said external annular element and said internal annular element being coaxially mounted one inside the other with the diameters thereof being reduced gradually with respect to each other, said external element being provided on its inner skirt surface with at least two axial guide slots angularly arranged in an equispaced relation, a radial tooth slidably engageable in each of said slots and extending from the outer skirt surface of the internal annular element, said axial guide slots being closed at their ends lying near the end edges of said external element, and being provided at one or both ends with end sections lying near the fore end edge and the rear end edge of said external annular element, said end sections of said axial guide slots being oriented transversely and with respect to said guide slots and extending in a same direction or in mutually opposite directions.

2. The annular structure according to claim 1, characterized in that the internal annular element has an inside diameter which corresponds to the diameter of a person's finger allowing to thread the annular structure on a person's finger, and the internal annular element is stationarily threaded thereon, the external annular element being axially shiftable on the internal annular element.

3. The annular structure according to claim 1, characterized in that the skirt surface of the internal annular element provides a surface for ornaments, precious stones, inscriptions, to be affixed thereon.

4. The annular structure according to claim 1, characterized in that the external and internal annular elements are provided with cooperating locking means for a removable locking of said elements in a superposed position of the external annular element on the internal annular element and/or in an exposed position of this latter element.

5. The annular structure according to claim 1, characterized in that the guide slots may have a quadrangular, triangular, part-circular, concave, dovetail cross-section, or a cross-section in form of a circle sector with a suitably wide angle.

6. The annular structure according to claim 1, characterized in that the external annular element has its fore end edge provided with a radially inward annular abutment flange.

* * * * *